US006209276B1

(12) United States Patent
Venegas, Jr.

(10) Patent No.: US 6,209,276 B1
(45) Date of Patent: Apr. 3, 2001

(54) INSTALLING A SLEEVE ONTO AN ELONGATED MEMBER

(76) Inventor: Frank Venegas, Jr., 4165 Homestead, Howell, MI (US) 48843

( * ) Notice: Subject to any disclaimer, the term of this patent is extended or adjusted under 35 U.S.C. 154(b) by 0 days.

(21) Appl. No.: 09/410,714

(22) Filed: Oct. 1, 1999

(51) Int. Cl.[7] ..... E04H 12/00
(52) U.S. Cl. ..... 52/301; 52/736.4
(58) Field of Search ..... 52/170, 169.13, 52/301, 723.1, 723.2, 736.3, 736.4, 741.3, 745.17, 737.4, 737.5; 256/DIG. 5, 1, 19, 59

(56) References Cited

U.S. PATENT DOCUMENTS

| | | | | |
|---|---|---|---|---|
| 1,463,715 | * | 7/1923 | Muhlow | 52/737.4 X |
| 1,875,137 | * | 8/1932 | Pollock | 52/301 X |
| 2,450,345 | | 9/1948 | Kervin . | |
| 3,319,328 | * | 5/1967 | Finger et al. | 52/301 X |
| 4,244,156 | | 1/1981 | Watts, Sr. | 52/728 X |
| 4,516,756 | * | 5/1985 | Beatty | 256/1 |
| 4,961,258 | | 10/1990 | Menzel . | |
| 5,222,344 | | 6/1993 | Johnson . | |
| 5,299,883 | * | 4/1994 | Arth, Jr. | 52/301 X |
| 5,315,796 | * | 5/1994 | Gruhlke | 52/169.13 X |
| 5,323,583 | | 6/1994 | Venegas, Jr. . | |
| 5,369,925 | * | 12/1994 | Vargo | 52/736.4 X |
| 5,735,310 | * | 4/1998 | Hipshire | 256/19 X |
| 6,065,268 | * | 5/2000 | Gump | 52/301 X |

* cited by examiner

*Primary Examiner*—Janet M. Wilkens
(74) *Attorney, Agent, or Firm*—Gifford, Krass, Groh, Sprinkle, Anderson & Citkowski, PC

(57) ABSTRACT

Trapped air is used to hold a sleeve onto an elongated member such as a vertical post or pillar. A sleeve is provided having an open end and a closed end, and an inner diameter which is at least slightly greater than the outside diameter of the member being covered. At least one spacer is provided circumferentially around the member, which is positioned proximate to the end over which the open end of the sleeve is placed for installation purposes. As the sleeve is subsequently urged over the member, air trapped between the end of the member including the spacer and the closed end of the sleeve is expelled past the spacer and out the open end of the sleeve between the outside wall of the member, such that when the sleeve is fully installed, a relatively small volume of air remains between the end of the member with the spacer and the closed end of the sleeve. With such a configuration, if one then attempts to pull the sleeve off the member, air movement past the spacer in the opposite direction is again very slow, preventing the sleeve from being pulled off the member without a substantial effort. In the preferred embodiment, two spaced-apart bands of resilient adhesive tape are used to provide the spacer material. In an alternative embodiment the sleeve itself may be formed having one or more circumferential bands with an inside diameter slightly less than the inside diameter of the sleeve overall.

11 Claims, 1 Drawing Sheet

INSTALLING A SLEEVE ONTO AN ELONGATED MEMBER

FIELD OF THE INVENTION

This invention relates generally to protective coverings and, in particular, to a method of installing a sleeve over an elongated member such as a rigid vertical post, stanchion, or the like.

BACKGROUND OF THE INVENTION

U.S. Pat. No. 5,323,583 discloses and claims a sleeve which may be used to cover a rigid structure, thereby providing a more decorative appearance while protecting against exposure to the element and externally applied impacts. According to one physical implementation, such a sleeve has a closed, rounded top and an open bottom, allowing it to be slipped over an existing upright post, typically constructed of a rigid material such as steel or cast cement.

Depending upon the circumstances, sleeves of this kind may be placed over a vertical support without any fastening whatsoever. For example, if used indoors or in an area where theft or vandalism is precluded, attaching the sleeve to the post may be unnecessary or impractical. For many applications, however, including those which are used out-of-doors to cover posts around parking areas, and the like, it is preferred that the sleeve somehow be attached to the post that it is protecting.

Although an adhesive may be used to bond the sleeve to the post it is covering, this technique presents certain disadvantages. For one, adhesives tend to be messy, and flow down the outside of the post or inner wall of the sleeve and accumulate in an unsightly manner. In addition, the holding power of certain adhesives become compromised due to changes in temperature, humidity or exposure to ultraviolet radiation, and such conditions could easily change in an outdoor environment. The need remains, therefore, for an alternative method of installing sleeves of this kind onto posts and other elongated members. Ideally, such a method would be cleaner, while at the same time, providing adequate protection against removal.

SUMMARY OF THE INVENTION

Broadly, and in general terms, the present invention utilizes trapped air to hold a sleeve onto an elongated member. The invention is applicable to sleeves of the type having a closed top and an open bottom and configured for installation onto a vertical post or pillar. In reading this specification, however, one of skill will realize that the invention has other applications, including the installation of sleeves onto non-vertical members, and that such members may be hollow or solid, so long as trapped air is used to provide sufficient holding power as described herein.

According to a method aspect of the invention, a sleeve is provided having an open end and a closed end, and an inner diameter which is at least slightly greater than the outside diameter of the member being covered. At least one spacer is provided circumferentially around the member, which is positioned proximate to the end over which the open end of the sleeve is placed for installation purposes. As the sleeve is subsequently urged over the member, air trapped between the end of the member including the spacer and the closed end of the sleeve is expelled past the spacer and out the open end of the sleeve between the outside wall of the member, such that when the sleeve is fully installed, a relatively small volume of air remains between the end of the member with the spacer and the closed end of the sleeve. With such a configuration, if one then attempts to pull the sleeve off the member, air movement past the spacer in the opposite direction is again very slow, preventing the sleeve from being pulled off the member without a substantial effort. Indeed, to most would-be thieves, the evacuative effect created by the trapped air makes it appear as though the sleeve is permanently bonded to the member, even though trapped air is used as opposed to an adhesive.

In the preferred embodiment, resilient adhesive tape is used to provide the spacer material. In particular, neoprene tape having a thickness on the order of ⅛" is suitable, as are other thicknesses and compressibilities, depending upon the dimensions of the sleeve and member being covered. Although a single spacer may be used to practice the invention, in the preferred embodiment, at least two bands of spacer material are used, one placed close to each end of the member being covered with the sleeve. It has been found that the use of two or more spacers prevents rattling, particularly at the bottom of the sleeve, while providing further stability against lift off.

It has also been found that, to more readily facilitate installation at the sleeve, the spacer closest to the end over which the open end of the sleeve is placed preferably includes at least one gap as opposed to complete circumferential coverage. This gap enables air to more quickly escape while, particularly when more than one spacer is used lengthwise along the member, removal remains sufficiently difficult. In an alternative embodiment, as opposed to the spacer material being applied directly to the member being covered, the sleeve itself may be formed having one or more circumferential bands with an inside diameter slightly less than the inside diameter of the sleeve overall, thereby acting as tape-like spacers when the sleeve is installed over the member.

DETAILED DESCRIPTION OF THE INVENTION

Figure 1:
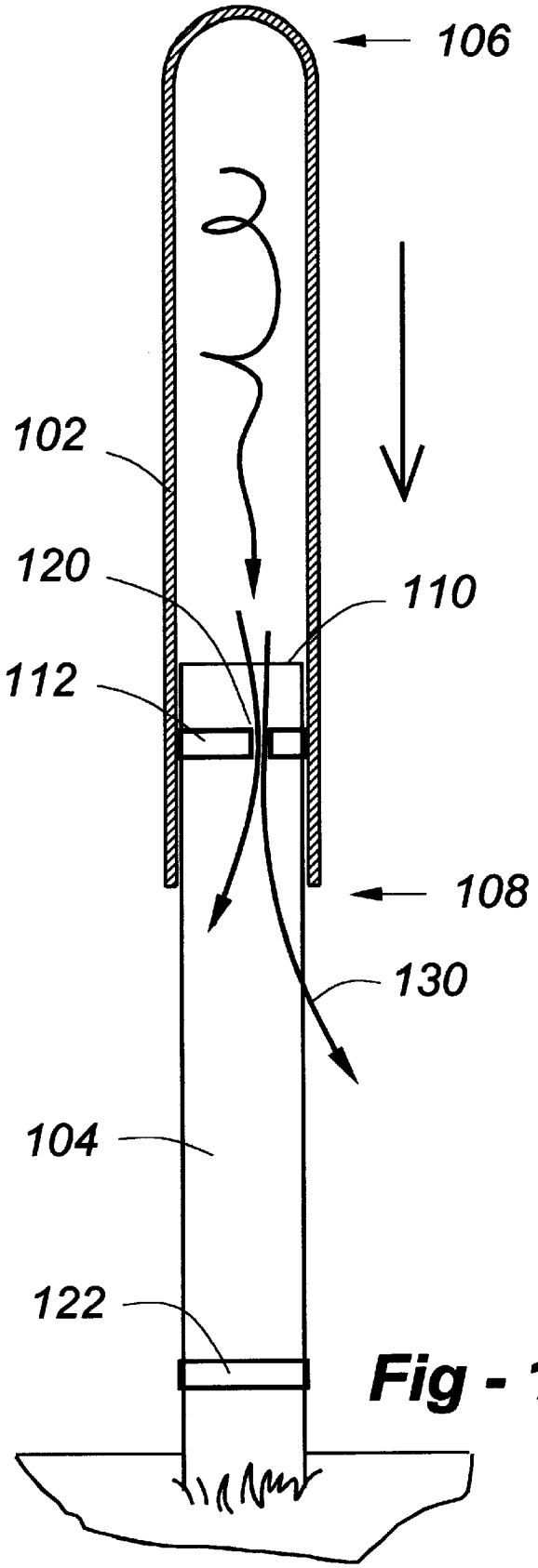
FIG. 1 is a drawing of a sleeve being placed over a vertical post according to the invention utilizing upper and lower tape spacers, and with the upper spacer having a gap to enhance installation.

FIG. 1 illustrates a method of installing a sleeve 102 onto an elongated member, in this case a vertical post 104. It is assumed that the sleeve has a closed end 106 and an open end 108 which is placed over the upper end 110 of the post being covered, and that the inside diameter of the sleeve is slightly greater than the outside diameter of the post. According to a preferred method of the invention, a piece of compressible adhesive tape 112 or other resilient material such as neoprene is placed circumferentially around the post at a distance spaced apart from the upper end, such as a few inches.

Although the spacer created through the use of the tape may be placed all the way around the post being covered, it is found that a gap 120 advantageously allows a sleeve to be put on more quickly while remaining sufficiently difficult to pull the sleeve off, once installed. In the event that the inside diameter of the sleeve and the outside diameter of the post is thicker than the thickness of the tape, a thicker spacer material may be used or layers of tape may be added.

Although the invention will be successful using only a single spacer proximate to the upper end of the post, is has been found that a lower spacer 122 helps not only to enhance stability of the sleeve once installed, but also to assist in trapping more air to thwart removal.

The sleeve is placed over the post including the spacer(s), preferably using a twisting motion to slowly slide the sleeve over the post with the spacer(s) attached. If the sleeve is being applied correctly, the installer will hear air 130 being forced out of the sleeve as it is slid on.

Once the sleeve is properly slid all the way down the post with the spacer(s), it will be very difficult to pull the sleeve off of the post due to the air being trapped therein, and the inability to replace the air being trapped because of the spacers between the inside wall of the sleeve and the outside wall of the post. In the event that the sleeve is still easily removed from the post bearing the spacer(s), a greater thickness of spacer material may be implied, as discussed above.

Figure 2:
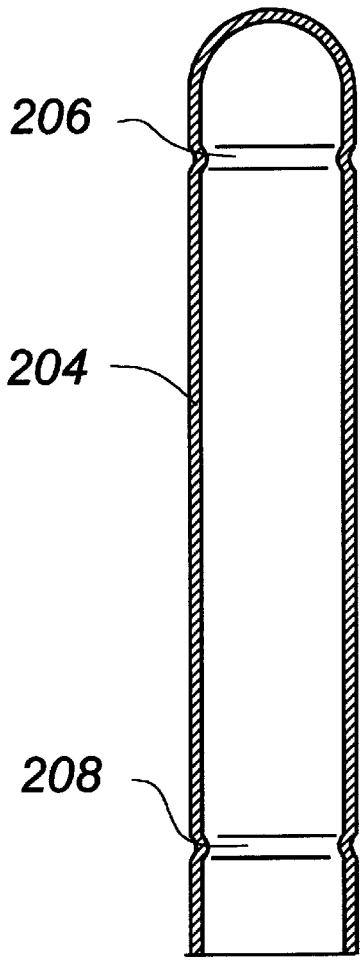
FIG. 2 illustrates an alternative embodiment of the invention wherein the sleeve itself has one or more circumferential band with a smaller inside diameter to hold the sleeve by trapping air.

FIG. 2 illustrates an alternative embodiment of the invention, wherein the sleeve 204 itself has one or more bands with a slightly smaller inside diameter, thereby performing the function of the tape described with reference to FIG. 1. It will be noted that although according to the tape embodiment, at least the upper end of the member being covered must be supplied with the spacer, whereas, if the spacer is integral to the sleeve, at least a lower or open end of the sleeve must include the necked-in band.

Preferably, however, as in the case of the tape described with reference to FIG. 1, at least two necked-in bands 206 and 208 are used, one situated proximate to the closed end of the sleeve, and one proximate to the open end. Each necked-in band may also not extend entirely circumferentially around the sleeve, but may include a gap, much like the gap in the tape discussed with reference to FIG. 1. In terms of manufacture, the necked-in portions of the sleeve may be fabricated by applying a heated ring in a compressive manner to the outside circumference of the sleeve at spaced-apart points sufficient to change the inside diameter.

It should be noted that the embodiments; namely, the use of tape and necked-in rings on the sleeve itself, are not mutually exclusive, but may, in fact, be used in conjunction with one another so long as the geometry permits. Also, in the case of the tape embodiment, and the event that the sleeve is at least partially translucent or transparent, it is preferable to use a light-colored tape or a tape which matchers the color of the sleeve or post, as the case may be, so that the band of spacer material is not visibly apparent once the sleeve is fully installed.

I claim:

1. A method of insulating a sleeve having a closed end, an open end and an inside diameter onto an elongated member having a first end, a second end, and an outside diameter at least slightly less than the inside diameter of the sleeve, the method comprising the steps of:

providing a band of spacer material circumferentially around the member proximate to the first end thereof;

placing the open end of the sleeve over the first end of the member and over the spacer material;

urging the sleeve onto the member while, at the same time, expelling air trapped between the first end of the member and the closed end of the sleeve past the spacer material; and continuing to urge the sleeve onto the member until the sleeve covers a desired portion of the member, the tolerances between the sleeve, spacer material and member being sufficiently tight that a substantial vacuum is created sufficient to deter or prevent subsequent removal of the sleeve from the member.

2. The method of claim 1, wherein the band of spacer material does not extend entirely circumferentially around the member but, rather, includes one or more gaps to expedite the passage of air past the spacer as the sleeve is installed.

3. The method of claim 1, wherein the step of urging the sleeve onto the member includes a step of applying a twisting motion while so urging.

4. The method of claim 1, further including the step of applying a second circumferential band of spacer material proximate to the second end of the member.

5. The method of claim 1, wherein the elongated member is a rigid, vertical post.

6. The method of claim 1, wherein the spacer material comprises a piece of compressible adhesive tape.

7. The method of claim 1, wherein:

the sleeve is at least partially transparent; and the color of the spacer material is chosen so as not to be visually apparent when the sleeve is installed.

8. The method of claim 1, wherein the spacer comprises a piece of neoprene adhesive tape.

9. A method of insulating a sleeve having a closed end, an open end and an inside diameter onto an elongated member having a first end, a second end, and an outside diameter at least slightly less than the inside diameter of the sleeve, the method comprising the steps of:

providing a spacer circumferentially around the sleeve, wherein the spacer is provided by necking-in a circumferential band of the sleeve, thereby creating a ring having a slightly smaller inside diameter;

placing the open end of the sleeve over the first end of the member;

urging the sleeve onto the member while, at the same time, expelling air trapped between the first end of the member and the closed end of the sleeve past the spacer, and continuing to urge the sleeve onto the member until the sleeve covers a desired portion of the member, the tolerances between the sleeve, spacer and member being sufficiently tight that a substantial vacuum is created sufficient to deter or prevent subsequent removal of the sleeve from the member.

10. The method of claim 9, further including the step of applying a second spacer around the sleeve.

11. The method of claim 9, wherein the elongated member is a rigid, vertical post.

* * * * *